US005315493A

United States Patent [19]

Huang

[11] Patent Number: 5,315,493

[45] Date of Patent: May 24, 1994

[54] FLASHLIGHT

[76] Inventor: Juei-Nuan Huang, No. 42, Rei Feng Rd., Wu Feng Hsiang, Taichung Hsien, Taiwan

[21] Appl. No.: 53,445

[22] Filed: Apr. 28, 1993

[51] Int. Cl.[5] ..... F21L 7/00

[52] U.S. Cl. ..... 362/202; 362/187; 362/206

[58] Field of Search ..... 362/205, 206, 207, 203, 362/188, 192, 202, 198, 187

[56] References Cited

U.S. PATENT DOCUMENTS 2,937,266 5/1960 Munro ..... 362/192

4,733,337 3/1988 Bieberstein ..... 362/202

5,113,326 5/1992 Maglica ..... 362/205

5,122,938 6/1992 Pastusek ..... 362/206

*Primary Examiner*—James C. Yeung

*Attorney, Agent, or Firm*—Bacon & Thomas

[57] ABSTRACT

A flashlight having a body with a first externally threaded end engaged by a tubular head and a second internally threaded end engaged by a plug, whereby the focus of the flashlight may be adjusted by rotating the tubular head relative to the first end of the body and the flashlight may be turned off and on by rotating the plug relative to the second end of the body.

1 Claim, 2 Drawing Sheets

FLASHLIGHT

BACKGROUND OF INVENTION

1. Field of Invention

The present invention relates to a flashlight.

2. Related Prior Art

U.S. Pat. No. 4,656,565 teaches a flashlight having an adjustable focus. However, such a flashlight is complicated in structure. Therefore, the present invention is intended to solve this problem.

SUMMARY OF INVENTION

It is an object of the present invention to provide a flash light which has a tubular conductive body having a first end on which an external threading is formed, a second end wherein an internal threading is formed and an annular portion which is formed in the first end and defines a hole, an isolating seat which defines a first slot and a second slot and is sandwiched between the annular portion and a C-ring which is retained in the tubular conductive body by means of a frictional force between itself and the tubular conductive body, a first conductive receiver having a first section received in the first slot and a second section sited outwardly of the isolating seat, a second conductive receiver having a first section received in the second slot and a second section sandwiched between the annular portion and the isolating seat, a bulb having a first leg received within the first section of the first conductive receiver and a second leg received within the first section of the second conductive receiver, a lens mounted in a tubular head wherein a threading is formed for engaging with the threading formed on the first end of the body so that the lens may be adjusted relative to the tubular conductive body by rotating the lens relative to the tubular conductive body and a spring attached to a plug on which a threading is formed for engaging with the threading formed in the second end of the body so that the spring has an adjustable portion in the tubular conductive body by rotating the plug relative to the tubular conductive body.

For a better understanding of the present invention and objects thereof, a study of the detailed description of the embodiments described hereinafter should be made in relation to the accompanying drawings.

BRIEF DESCRIPTION OF DRAWINGS

The present invention will be described in detail with reference to drawings showing the preferred embodiment thereof, wherein.

DETAILED DESCRIPTION OF PREFERRED EMBODIMENT

Figure 1:
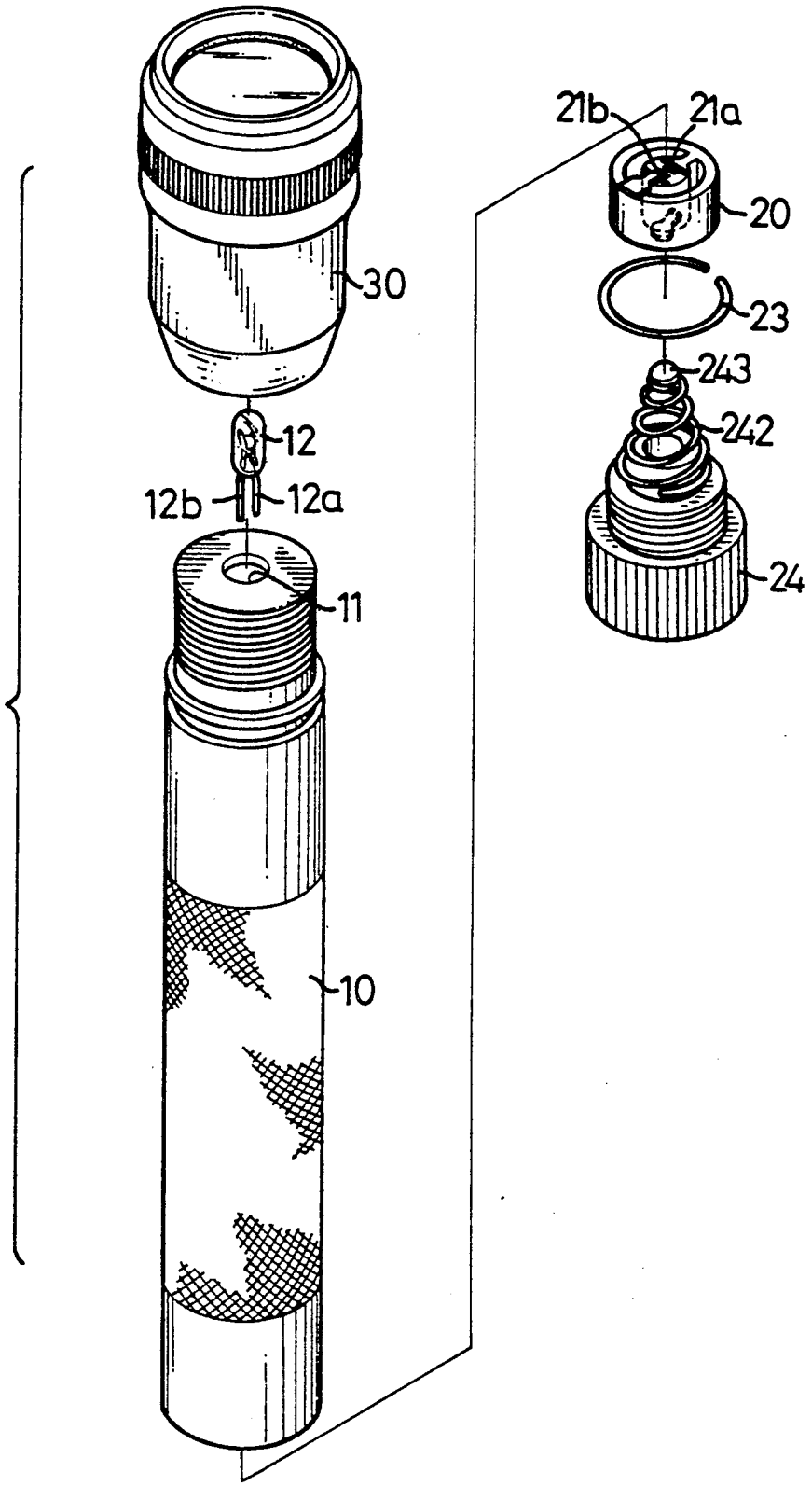
FIG. 1 is an exploded perspective view of a flashlight in accordance with the preferred embodiment of the present invention.

Initially referring to FIG. 1, a flashlight has a tubular electrically conductive body 10 having an outer side and an inner side. The body 10 has a hole 11 defined by means of an annular portion formed on a first end thereof and an opening formed through a second end thereof.

An electrically isolating cylindrical seat 20 has a first slot and a second slot longitudinally formed therethrough.

A first conductive receiver 21*a* has a first section and a second section. The first section of the first receiver 21*a* has a U-shaped form as shown in a top view. The second section of the first receiver 21*a* is a strip projecting from the first section. The first section of the first receiver 21*a* is mounted in the first slot formed through the seat 20. The second section of the first receiver 21*a* projects downward out of the seat 20 and is bent perpendicular to the axis of the first section of receiver 21*a*.

A second conductive receiver 21*b* has a first section and a second section. The first section of the second receiver 21*b* has a U-shaped form as shown in a top view. The second section of the second receiver 21*b* is a strip projecting from the first section. The first section of the second receiver 21*b* is mounted in the second slot. The second section of the second receiver 21*b* projects upward out of the seat 20 and is bent perpendicular to the axis of the first section of receiver 21*b*.

The seat 20, together with the receivers 21*a* and 21*b*, is sited in the tubular body 10, and is restrained from passing through the hole 11 as it has a diameter greater than that of the hole 11. The second section of the second receiver 21*b* is sited against the annular portion formed on the first end of the tubular body.

The seat 20 is sandwiched between the annular portion of the tubular body 10 and a C-ring 23 which is retained in the tubular body 10 by means of a frictional force exerted between itself and the inner side of the tubular body 10.

A bulb 12 has a pair of legs 12*a* and 12*b*. The first leg 12*a* is inserted within the first section of the first receiver 21*a* and the second leg 12*b* is inserted within the first section of the second receiver 21*b*.

A threading is formed on the outer side of the body 10 at the first end of body 10. A tubular head 30 has an inner side and an outer side. The head 30 has a stepped form consisting of a first section and a second section. A bowl-shaped reflector is mounted in the first section of the head 30. The bowl-shaped reflector has a central hole through which the bulb 12 is insertable. A lens is mounted on the first section of the head 30 so as to cover the bowl-shaped reflector.

A threading is formed on the inner side of second section of the head 30. The head 30 can be mounted on the body 10 by engaging the threading formed on the inner side of the head 30 with the threading formed on the outer side of the first end of the body 10. The distance from the lens to the bulb 12 is adjustable by rotating the head 30 relative to the body 10, thereby adjusting the focus of the flashlight.

A threading is formed on the inner side of the body 10 near the second end. A conductive plug 24 has a stepped form with a first section and a second section. A threading is formed on the first section of the plug 24. The plug 24 can be mounted on the body 10 by engaging the threading formed on the first section of the plug 24 with the threading formed on the inner side of the second end of the body 10. The plug 24 is hollow for containing a spare bulb 12.

A conductive spring 242 made of metal has a first end to which a conductive block 243 is attached and a second end which is attached to the first section of the plug 24.

Two batteries forming a battery set are are sited in the body 10. The first leg of the bulb 12 contacts the first receiver 21*a* contacting the positive electrode of the battery set of which the negative electrode contacts the conductive block 243 contacting the spring 242 contacting plug 24 contacting the body 10 contacting the second receiver 21*b*. Thus, an electrical circuit is formed and causes bulb 12 to be turned on.

Figure 3:
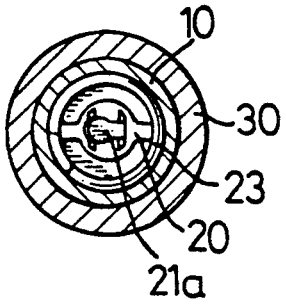
FIG. 3 is a cross-sectional view taken along line 3—3 in FIG. 2.
Figure 2:
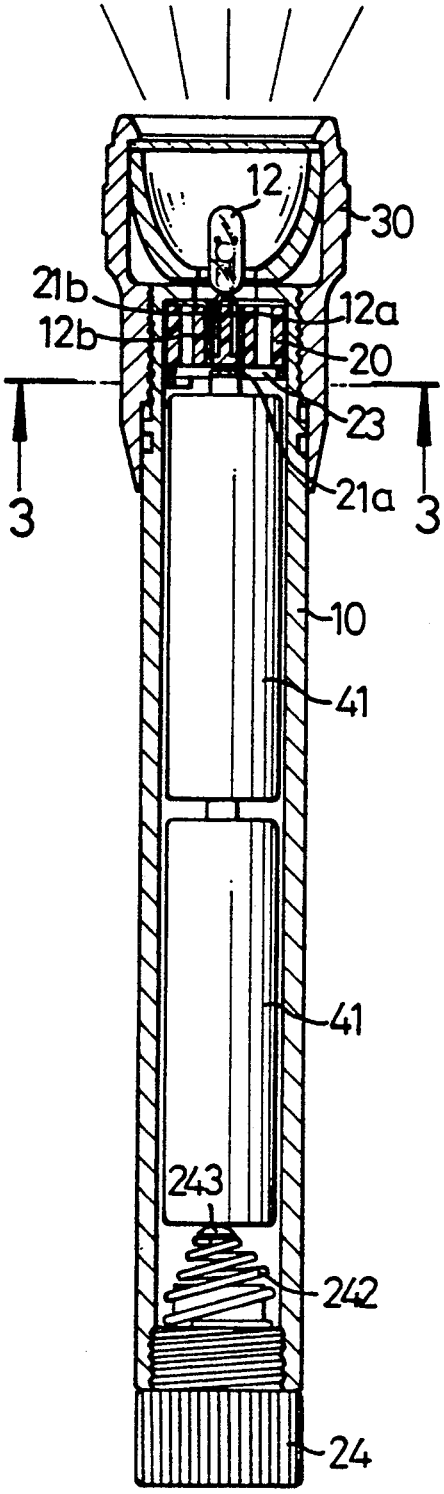
FIG. 2 is a cross-sectional view of a flashlight which is ON in accordance with the preferred embodiment of the present invention.

Additionally referring to FIG. 3 of the drawings, the plug 24 is rotated so as to be in a second position relative to the body 10 so that the electrodes of the battery set cannot simultaneously contact the second section of the first receiver 21*a* and the conductive block 243. This opens the circuit and causes bulb 12 to be turned off.

The focus of the flashlight is adjustable by rotating the head 30 relative to the body 10. The flashlight can be turned on/off by rotating the plug 24 with respect to the body 10. It is easy to operate such a flashlight. The possibility that power of the flashlight is turned off by mistake when the focus of the same is desired to be adjusted is reduced. The possibility that the focus of the flashlight is adjusted by mistake when the flashlight is desired to be turned on/off is also reduced. Furthermore, the flashlight in accordance with the present invention is simple in structure.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A flashlight comprising:

a) a tubular conductive body including a first externally threaded end and a second internally threaded end, and an annular portion formed on the first end and having a hole therethrough;

b) an isolating seat having first and second slots formed therethrough, a C-ring frictionally engaged within the conductive body and the isolating seat being disposed between the annular portion and the C-ring;

c) a first conductive receiver including a first section received in the first slot of the isolating seat and a second section positioned exteriorly of the isolating seat;

d) a second conductive receiver including a first section received in the second slot of the isolating seat and a second section disposed between the annular portion and the isolating seat;

e) a bulb including a first leg received in the first section of the first conductive receiver and a second leg received in the first section of the second conductive receiver;

f) a tubular head threadedly engaged on the threaded first end of the conductive body and a lens mounted within the tubular head, whereby rotation of the head relative to the body permits adjusting the distance between the lens and the bulb to change the focus of the flashlight; and g) a threaded plug engaged within the internally threaded second end of the conductive body and a spring secured to the plug for engaging a power supply disposed within the body and completing an electric circuit, whereby rotation of the plug closes and opens the circuit to turn the flashlight on and off.

* * * * *